US005570290A

United States Patent [19]

Foschi

[11] Patent Number: 5,570,290

[45] Date of Patent: Oct. 29, 1996

[54] ELECTRONIC FRANKING SYSTEM FOR POSTAL ITEMS

[75] Inventor: Vanni Foschi, Ivrea, Italy

[73] Assignee: Ing. C. Olivetti & C., S.p.A., Ivrea, Italy

[21] Appl. No.: 297,555

[22] Filed: Aug. 26, 1994

[30] Foreign Application Priority Data

Sep. 9, 1993 [IT] Italy ..... TO93A0060

[51] Int. Cl.[6] ..... G07B 17/02

[52] U.S. Cl. ..... 364/464.02; 177/25.15; 364/464.03

[58] Field of Search ..... 177/25.15, 25.18; 364/464.02, 464.03

[56] References Cited

U.S. PATENT DOCUMENTS

| | | | |
|---|---|---|---|
| 3,290,491 | 12/1966 | Wahlberg | 364/464.03 |
| 3,866,235 | 2/1975 | Maynard et al. | 346/22 |
| 4,024,380 | 5/1977 | Gunn | 364/467 X |
| 4,868,757 | 9/1989 | Gil | 364/464.03 |
| 4,923,022 | 5/1990 | Hsieh | 364/464.03 X |
| 4,940,887 | 7/1990 | Sheng-Jung | 364/464.03 X |
| 4,956,782 | 9/1990 | Freeman et al. | 364/464.03 |
| 5,233,532 | 8/1993 | Ramsden | 364/464.03 |
| 5,272,640 | 12/1993 | Wu | 364/464.02 |
| 5,340,948 | 8/1994 | Ramsden | 177/25.15 |
| 5,481,464 | 1/1996 | Ramsden | 364/464.03 |

FOREIGN PATENT DOCUMENTS

| | | |
|---|---|---|
| WO90/01742 | 2/1990 | WIPO . |
| WO90/04824 | 5/1990 | WIPO . |

*Primary Examiner*—Edward R. Cosimano
*Attorney, Agent, or Firm*—Banner & Allegretti, Ltd.

[57] ABSTRACT

The invention concerns an electronic franking system for postal items. The technical problem is that of franking the postal item correctly, without the intervention of postal administration staff. The system 31 is of the "self service" type, and comprises a cabinet 32 which houses an electronic unit 33, a keyboard 34, a screen 36, a compartment 64 for receiving the postal items 38, a mail unit 37 for weighing and franking the item 38 and post boxes 41 and 42. A vandal-proof door 77 separates the postal item 38 from the user during the weighing and franking operations. The system 31 also comprises a payment unit 43, a print device 44 for issuing a receipt and units for dispensing stamps 46 and envelopes 47.

10 Claims, 17 Drawing Sheets

ELECTRONIC FRANKING SYSTEM FOR POSTAL ITEMS

FIELD OF THE INVENTION

This invention refers to an electronic franking system for postal items comprising a weighing unit which can be activated to provide weight data concerning a postal item, and which determines a franking amount in relation to the above-mentioned weight data.

BACKGROUND OF THE INVENTION

A system of the type defined above is known; it consists of an actual franking machine and an apparatus separate from the franking machine, comprising the weighing unit, a keyboard for entering tariff data and an electronic unit. This system does not guarantee that the franked item is the same as that which was previously weighed. Thus a system of this type presupposes that the franking procedure is carried out by postal administration staff. If the system is used by users, the administration will then have to subsequently check that the postal items processed by the system are correctly franked.

SUMMARY OF THE INVENTION

One embodiment of this invention provides a franking system which receives a postal item and franks it correctly without the intervention of postal administration staff, and without the user being able to carry out further handling after the same postal item has been received.

This is achieved by an electronic franking system for postal items which is characterized by separating devices that render the weighing unit inaccessible to the user during its operation.

The franking system conveniently comprises a payment unit for inserting the monetary value equivalent to the franking amount determined by the weighing unit and the tariff data entry unit.

Another embodiment of this invention processes automatically, without the intervention of postal administration staff, postal items belonging to different tariff categories, such as ordinary mail and recorded mail.

This is achieved by a franking system for postal items, characterized by an automatic payment unit for entering the monetary value equivalent to the franking amount and by several post boxes for receiving the postal items after franking, in accordance with the selected tariff categories.

These and other aspects of the invention are defined in the appended claims to which reference should now be made.

BRIEF DESCRIPTION OF THE DRAWINGS

These and other characteristics of the invention will be obvious from the following description given by way of a non-limiting example, with the help of the attached drawings, where.

DETAILED DESCRIPTION OF PREFERRED EMBODIMENTS

Franking System

Figure 1:
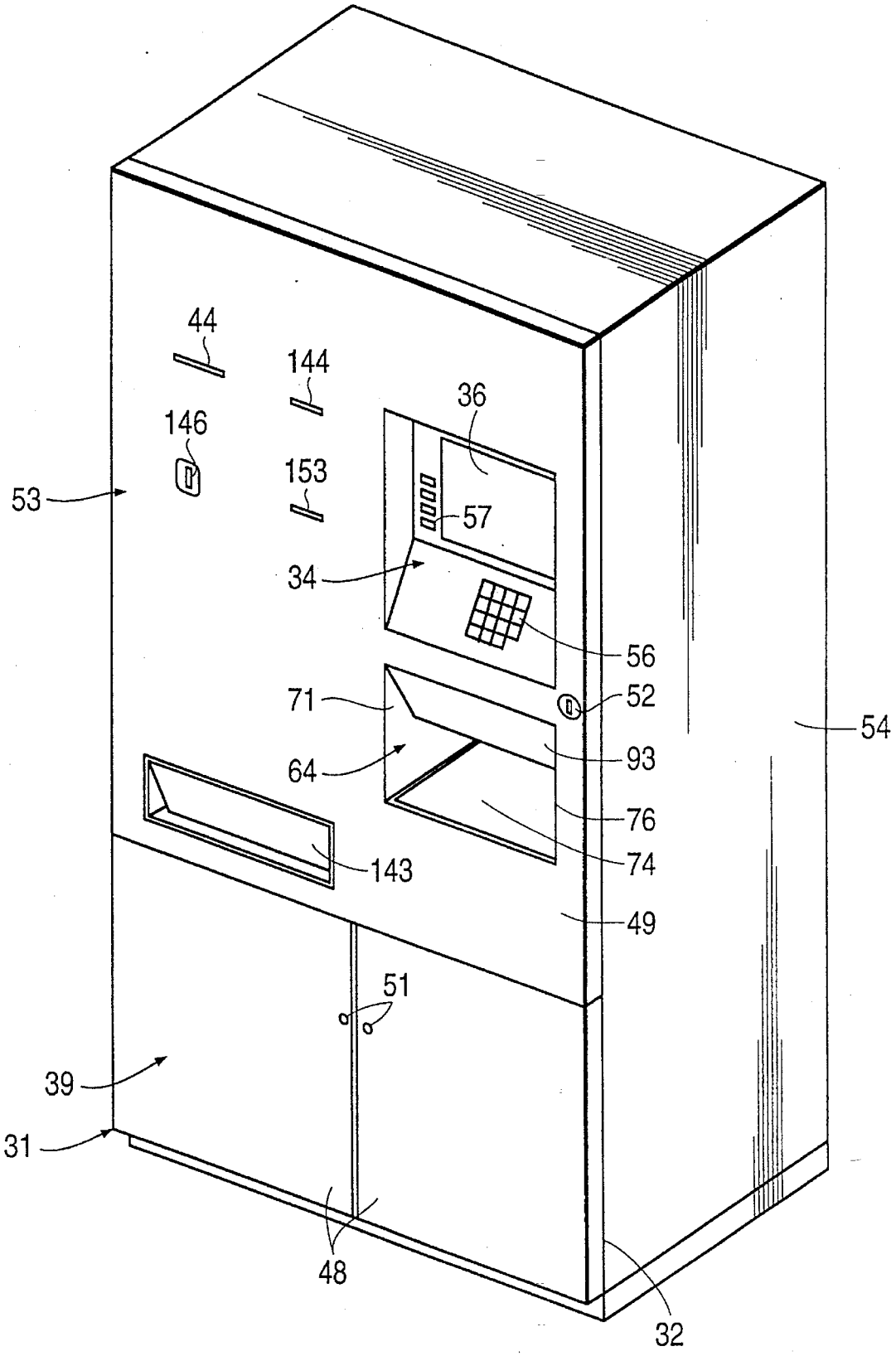
FIG. 1 shows a front right perspective view of a franking system embodying the invention.

With reference to FIGS. 1 to 4, the franking system is identified as 31, and it comprises a basic cabinet 32 which houses an electronic control unit 33, a data input and commands unit 34 for controlling the electronic control unit 33, a display unit 36 connected to the electronic control unit 33, a mail unit 37 that can be activated for weighing and franking a postal item 38 and a unit 39 for containing the post boxes 41 and 42 in which the postal items processed by the mail unit 37 are deposited.

The system 31 also comprises a payment unit 43, controlled by the electronic unit 33, for entering a monetary value equivalent to the franking amount of the postal item 38, and a print device 44 controlled by the electronic unit 33 for issuing a receipt.

The system 31 finally comprises a stamp dispensing unit 46 and an envelope dispensing unit 47, both connected to and controlled by the electronic control unit 33 and subordinate to the payment unit 43 for the supply of stamps and envelopes in a number defined by the user.

BASIC CABINET

The basic cabinet 32, illustrated in FIG. 1 et seq., is basically the shape of a parallelepiped, for example with dimensions of 950 mm in width, 640 mm in depth and 1850 mm in height, with front access and rack-type structure. At the bottom it houses the unit 39 containing the post boxes 41 and 42, and at the top it houses all the units and devices indicated by the numbers 33 to 44. The two parts are internally separated by metal panels, not shown on the drawings since they are not essential for an understanding of this invention, to protect the contents of the unit 39 against liquids or other materials that may be inserted by vandals into the system 31 and to prevent the operator assigned to collecting the post boxes from being able to access the units at the top and vice versa.

At the bottom of the cabinet 32, there are doors 48 at the front for accessing the unit 39 which contains the post boxes. At the top, there is a door 49 for accessing the units housed in it. The doors 48 and 49 can be locked by appropriate locks 51 and 52.

The basic cabinet 32 is completed by a right side 53 and a left side 54 made from walls that can be removed from the inside to provide easier access to the internal devices and units of the system 31.

Figure 2:
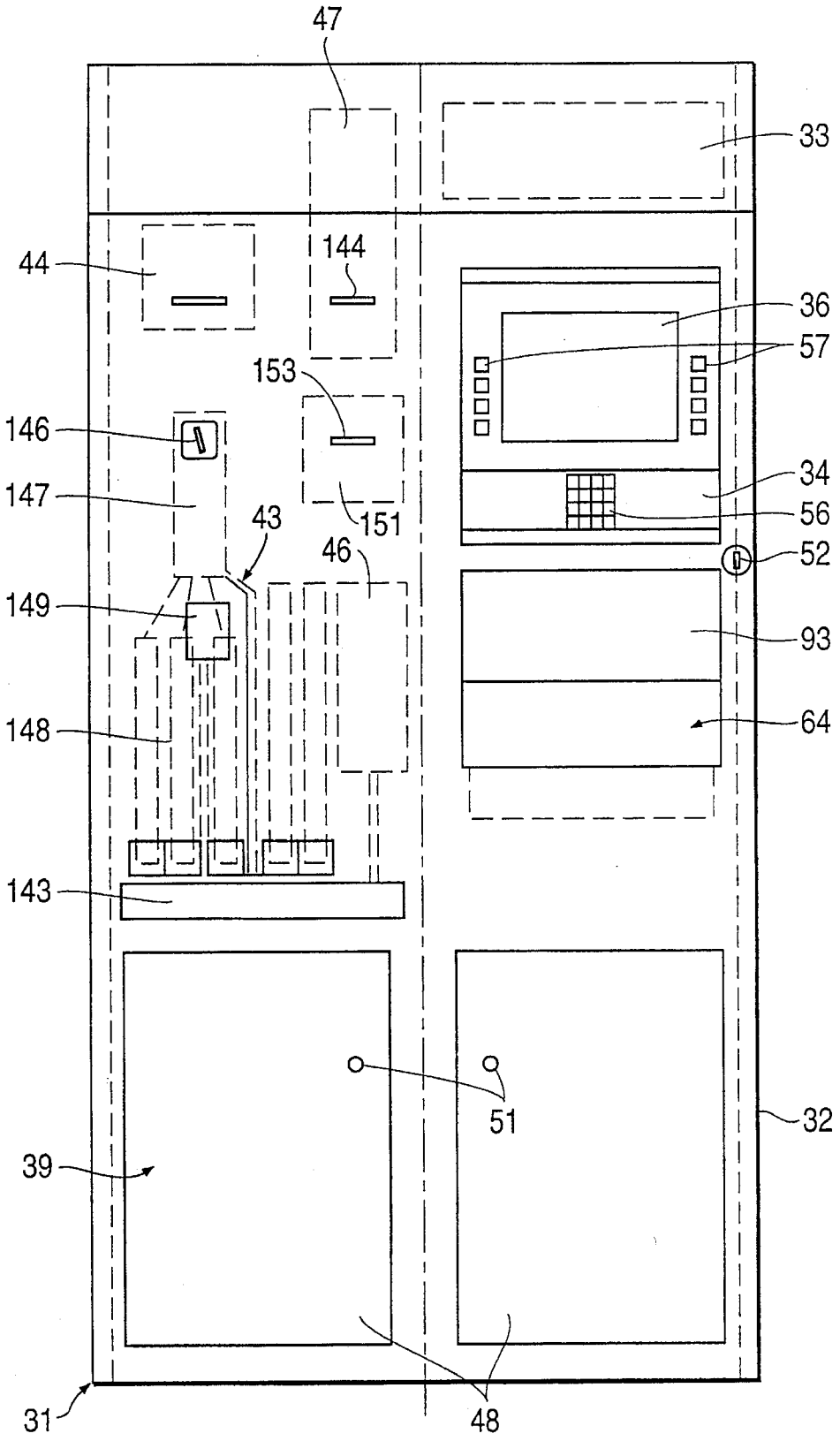
FIG. 2 shows a front view of the system of FIG. 1, depicting some internal units.
Figure 3:
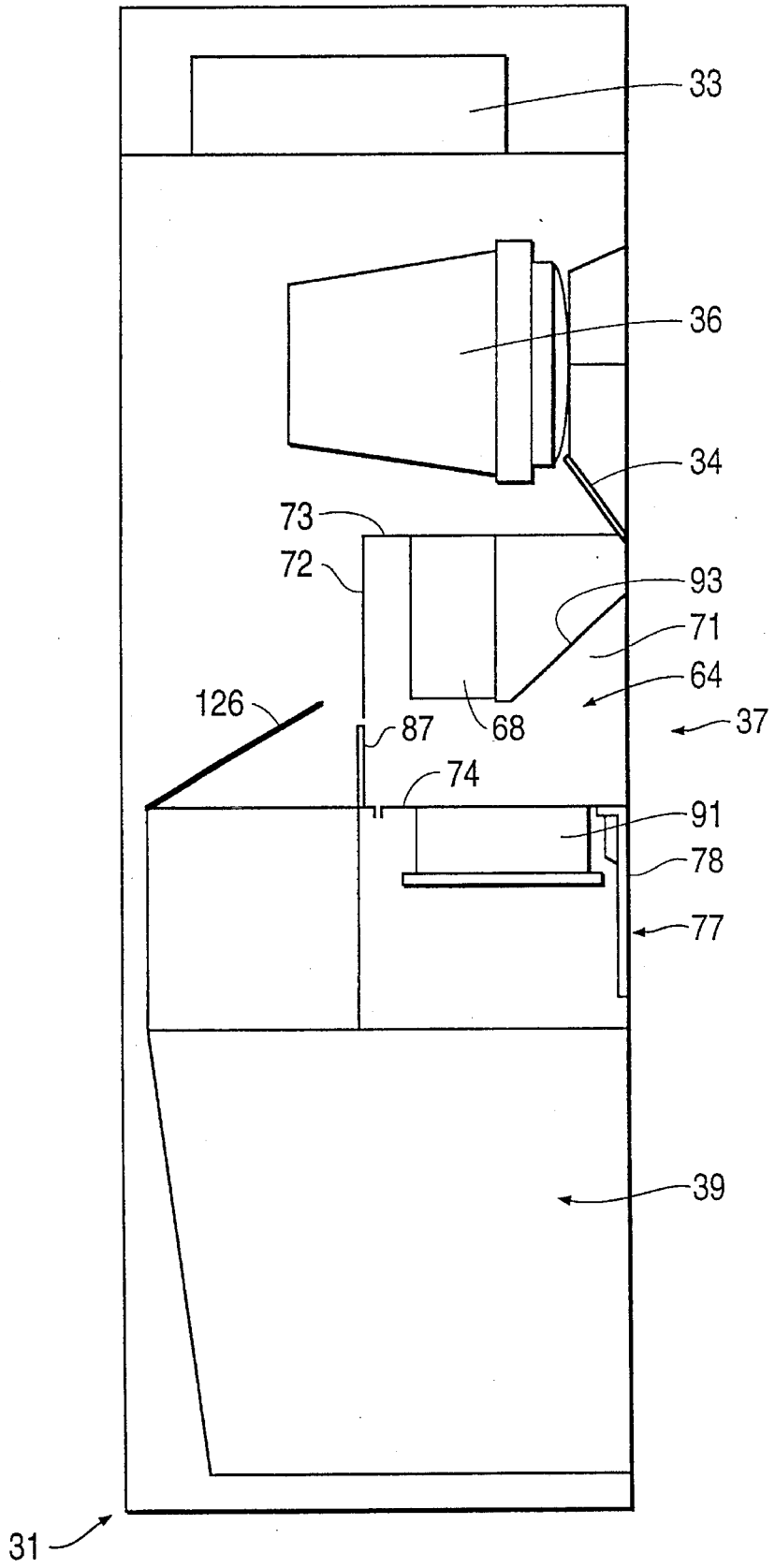
FIG. 3 shows a cross section of the picture in FIG. 2.
Figure 4:
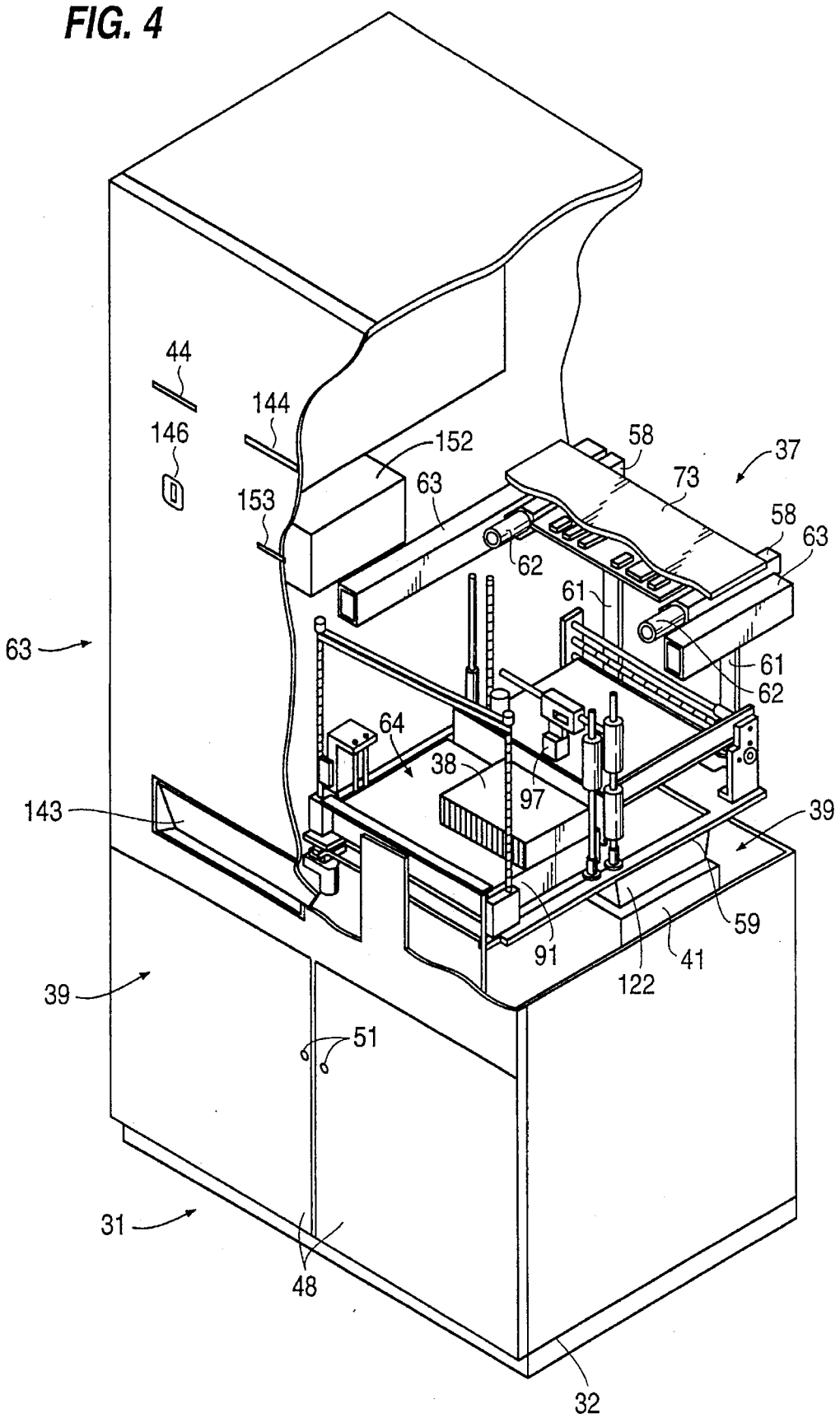
FIG. 4 shows a cutaway view of the system in FIG. 1, depicting the main parts of the system embodying the invention.
Figure 5:
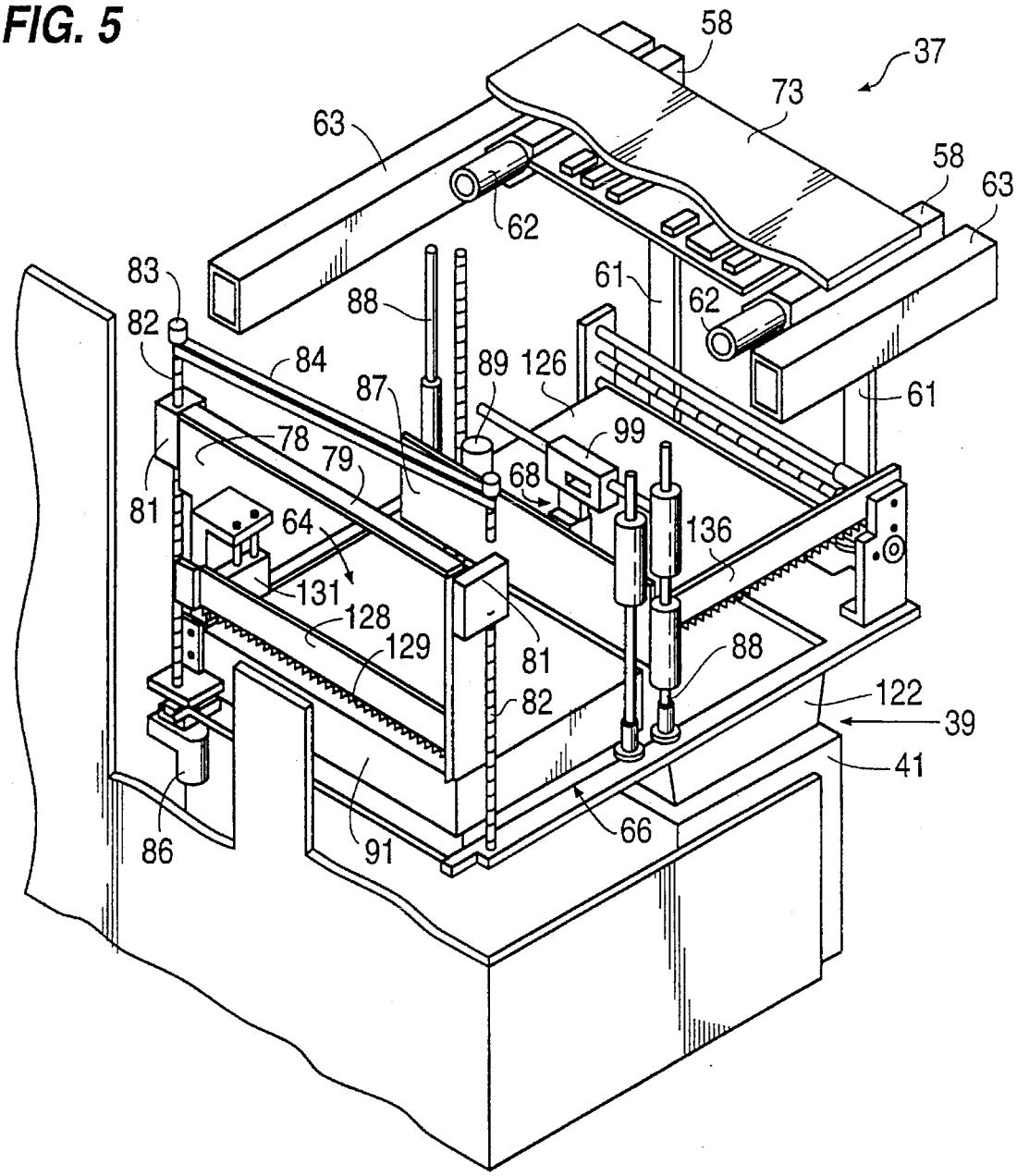
FIG. 5 shows a general perspective view of the parts in FIG. 4, on a larger scale.
Figure 13:
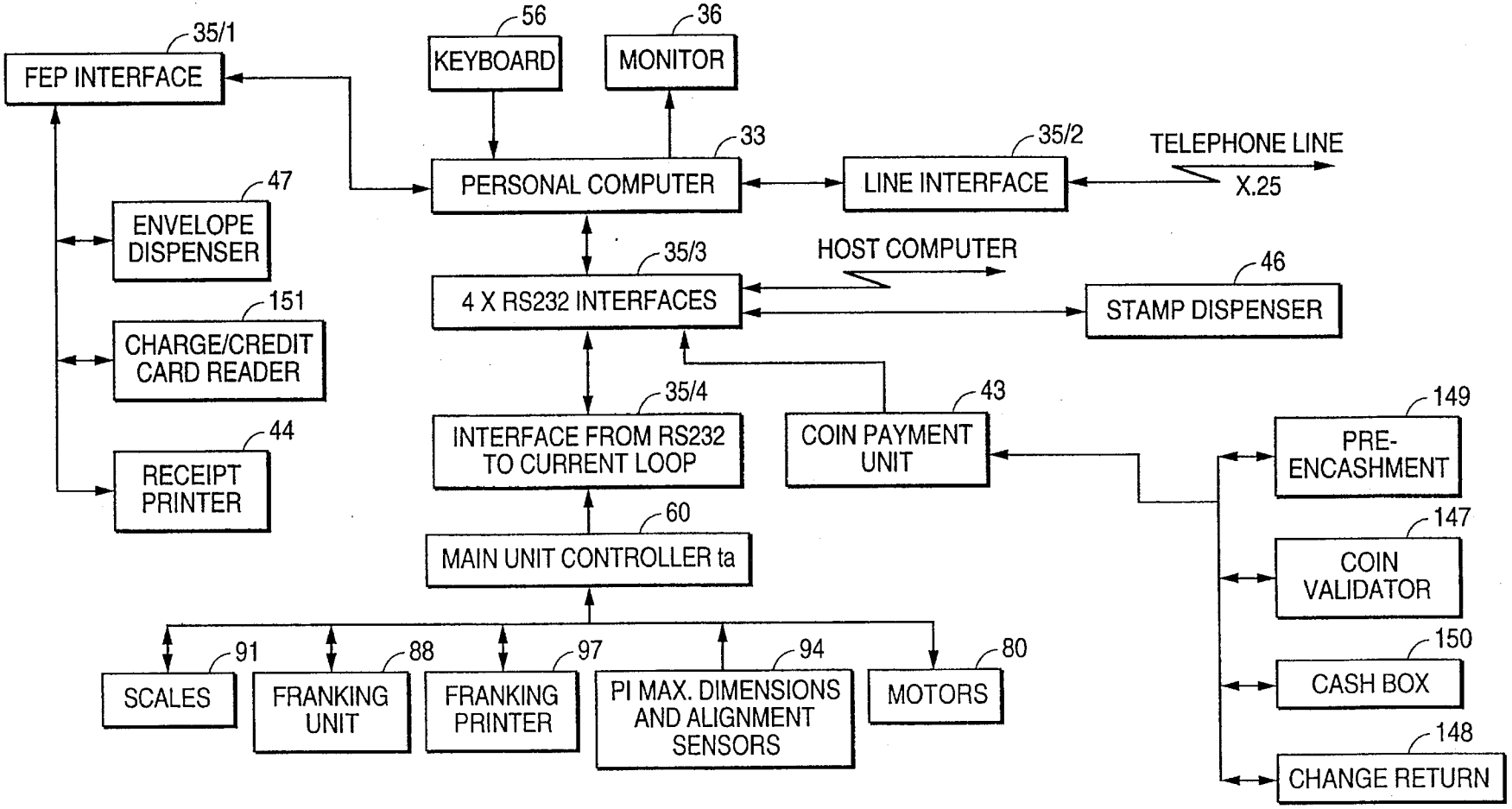
FIG. 13 is a block diagram of the electronic architecture of the system according to the invention.
Figure 14A:
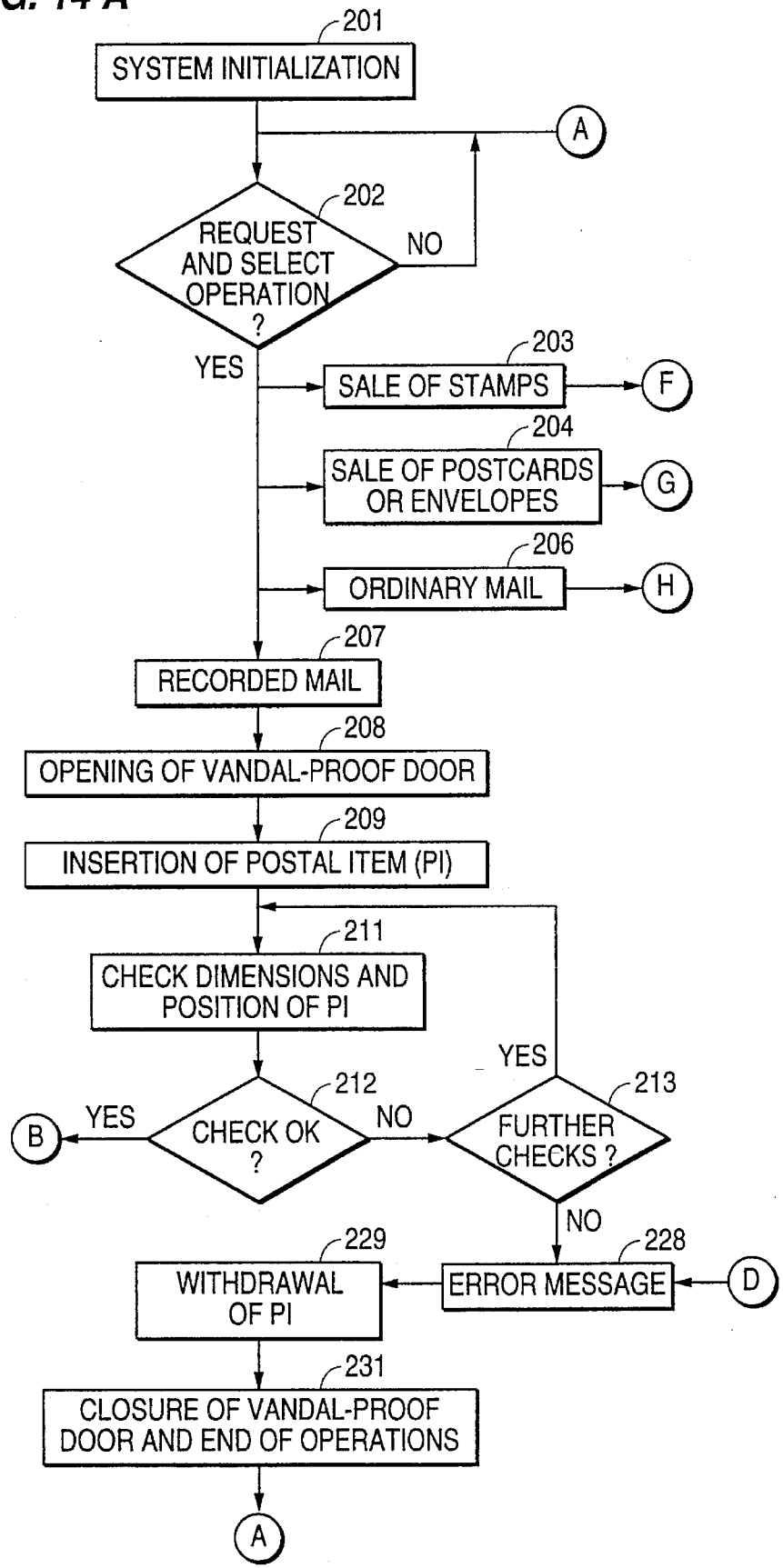
FIGS. 14A, 14B, 14C, 14D and 14E are a flow diagram of the operations of the system in FIG. 13.
Figure 14B:
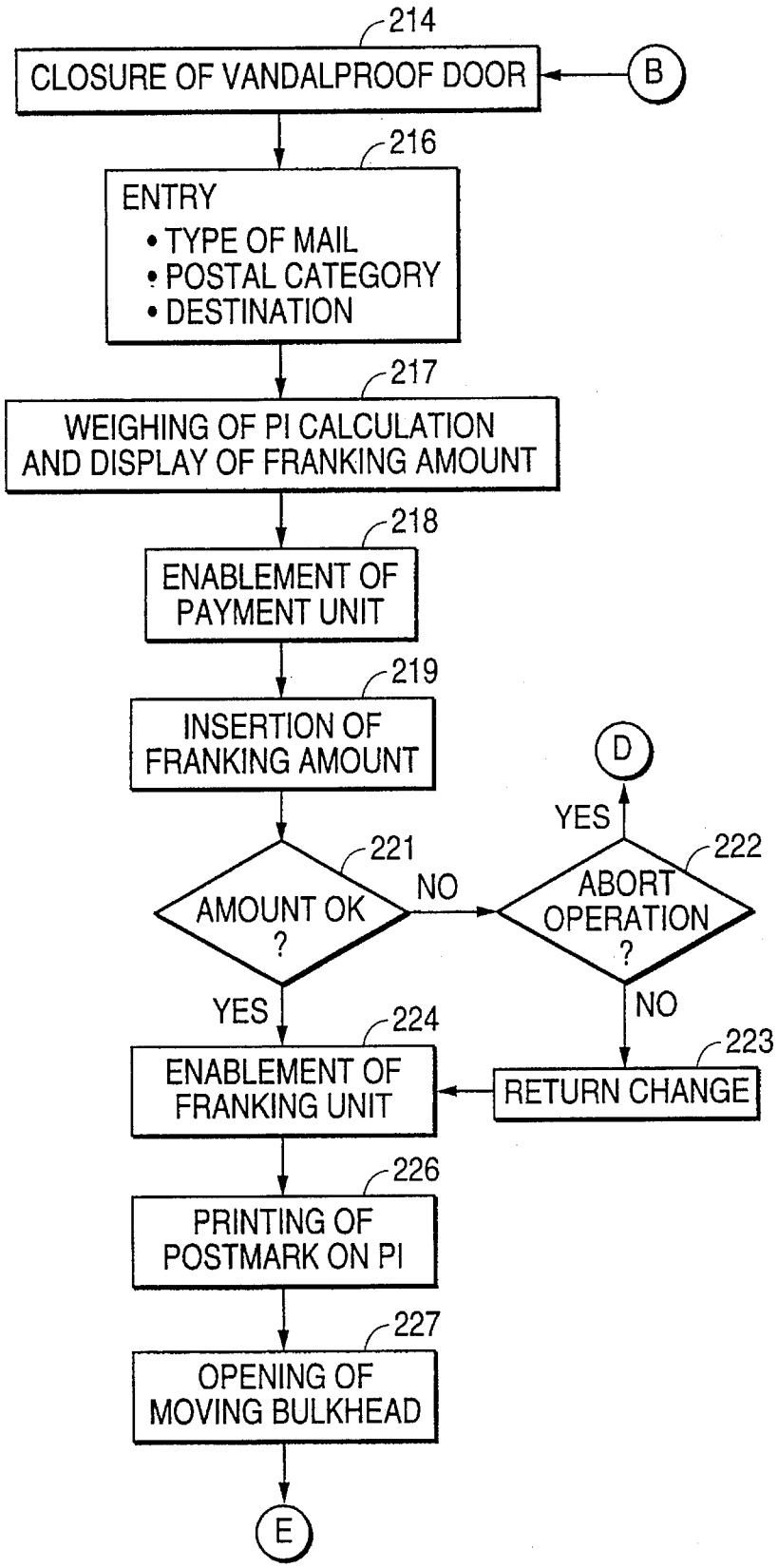
Figure 14C:
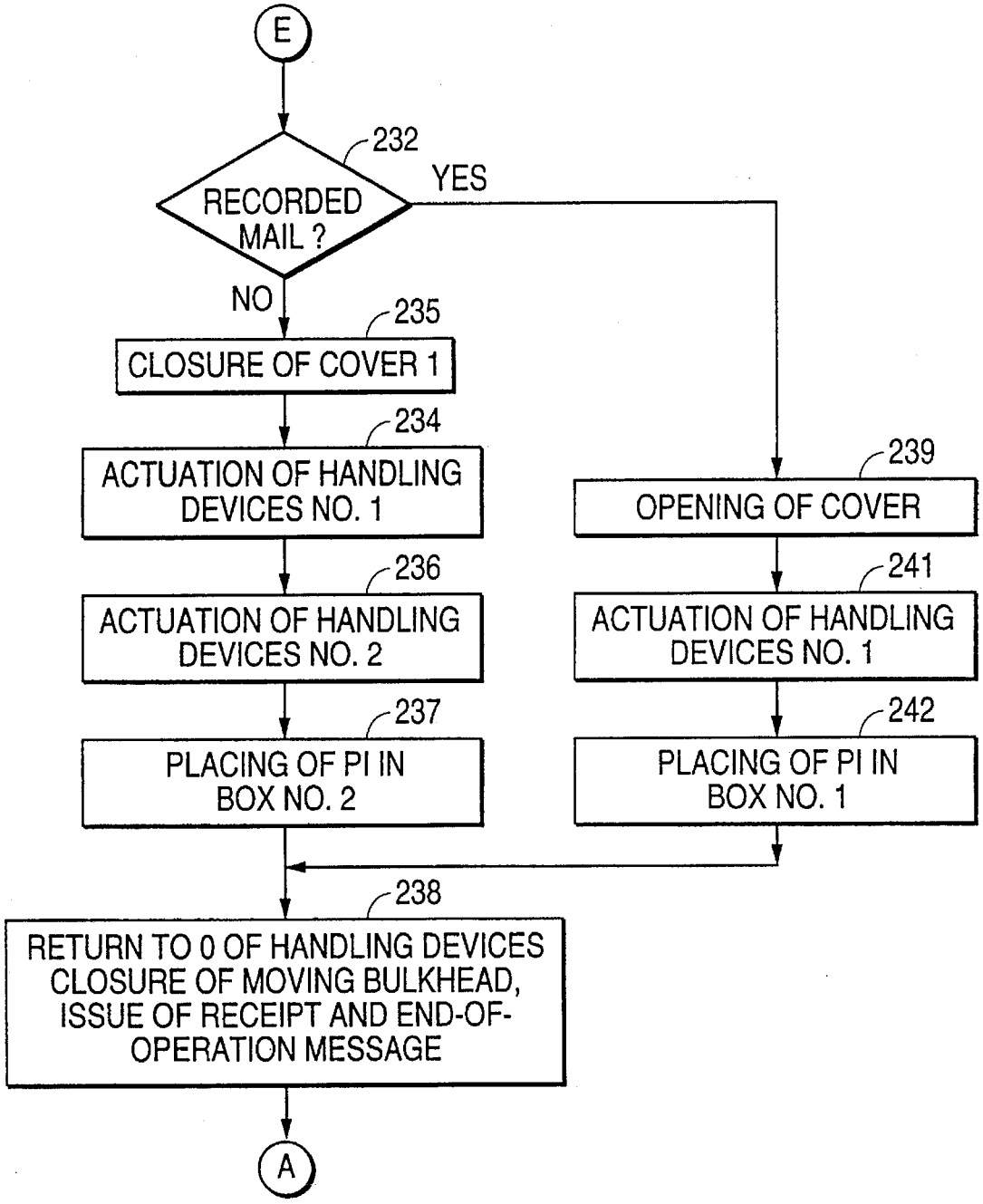
Figure 14D:
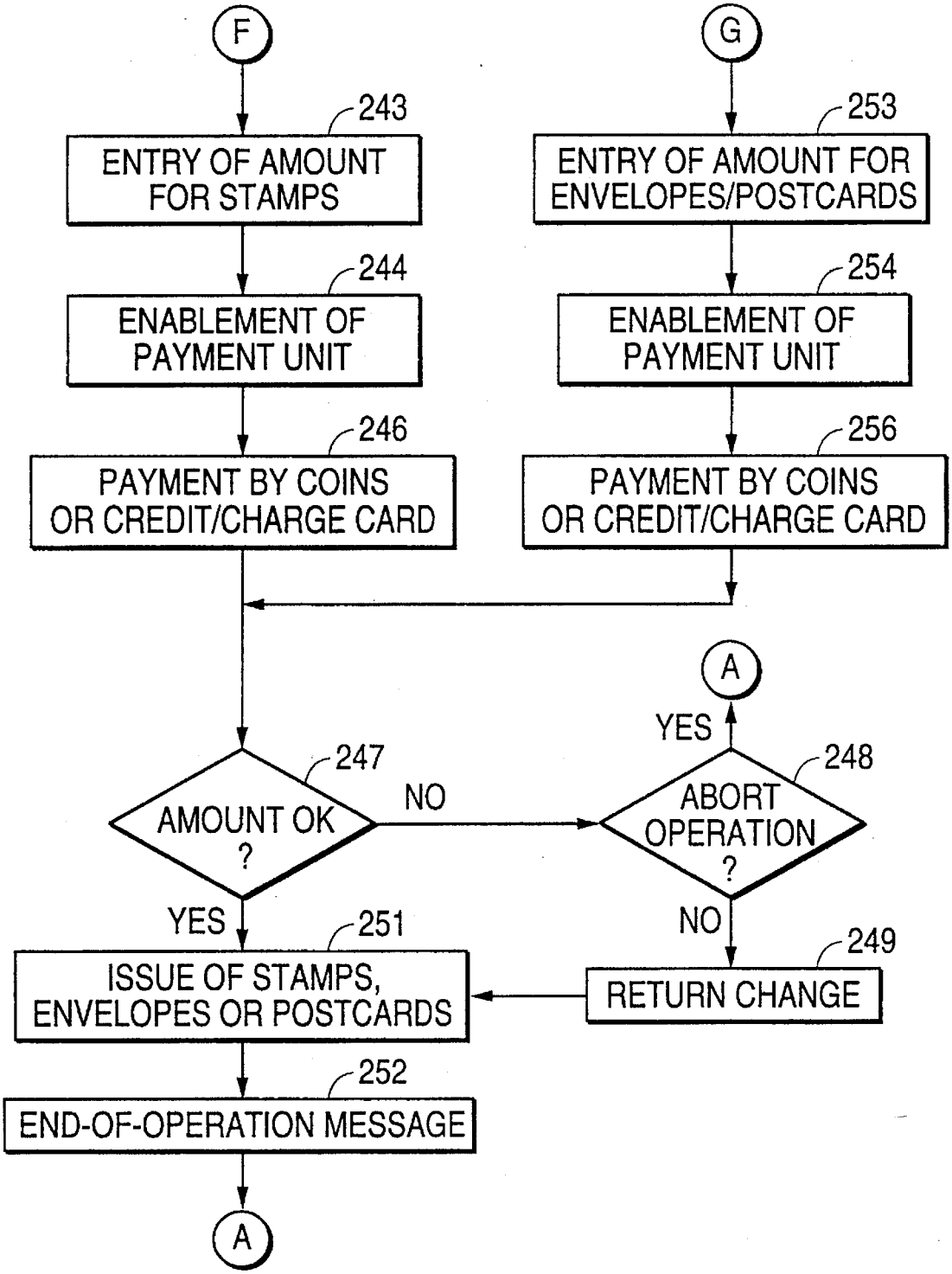
Figure 14E:
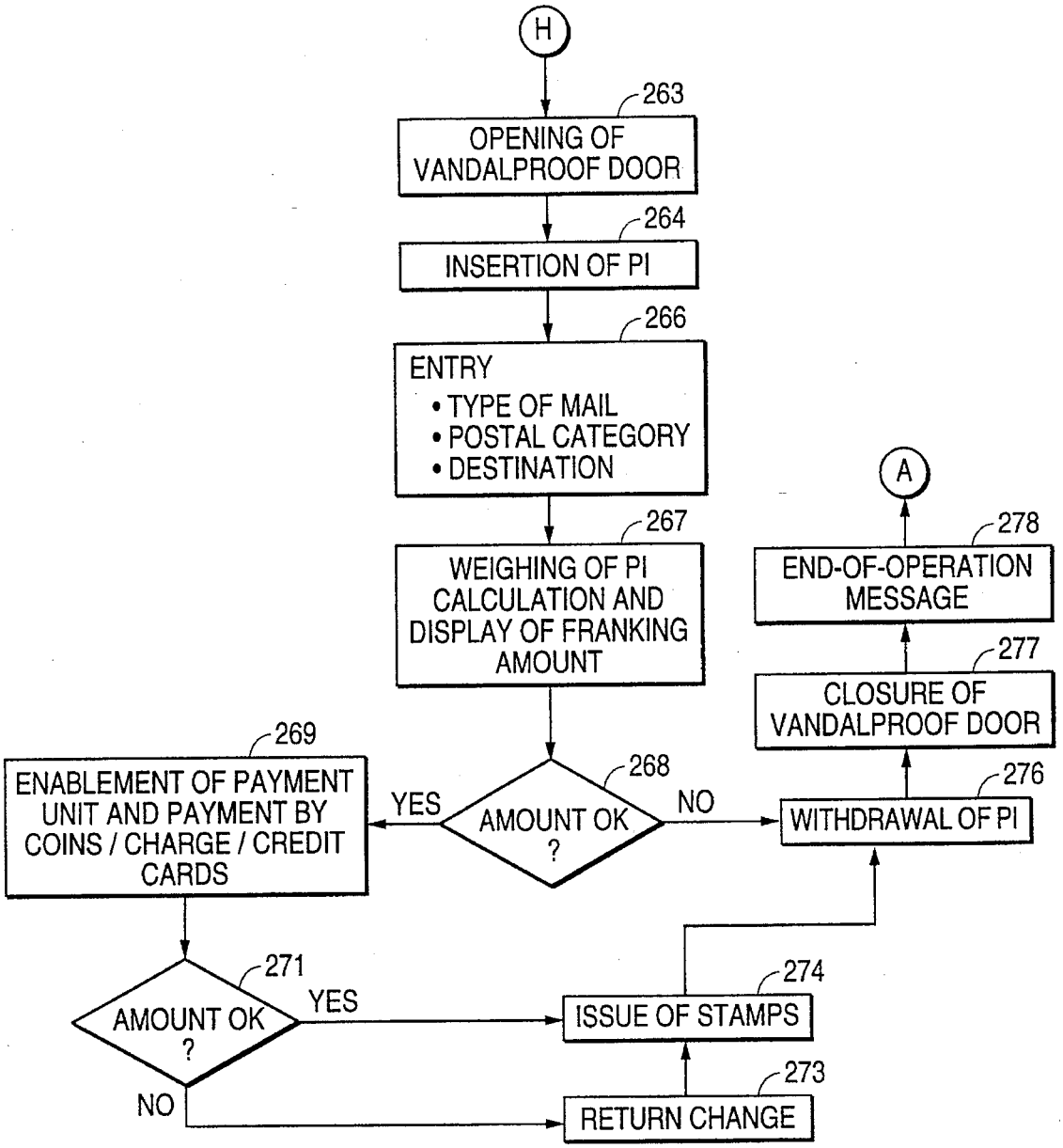

The electronic control unit 33, shown schematically in FIGS. 2, 3 and 13, is connected to the various units from 34 to 44 by means of appropriate RS232 serial, parallel and dedicated interfaces, and for the sake of brevity it is not described in detail.

The data and commands input unit 34 and the display unit 36 are located on the top door 49 of the cabinet 32 in a central position, at heights of between 1270 mm for the unit 34 and 1420 mm for the display unit 36, in accordance with criteria of ergonomic efficiency of the user interface which the system 31 must conform to.

The unit 34 comprises a keyboard 56 and function keys 57 suitably protected by a burglar-proof protective cover.

The display unit 36, per se of a known type, for example consists of a 14" VGA colour monitor and a monitor protection device, in turn comprising a glass pane framed by a metal burglar-proof frame. The unit 36 is mounted on a removable chassis guided by side guides, not shown in the figures, which permit easier access for example during maintenance.

The mail unit 37 basically has the structure of a parallelepiped, with width and height of about 350 mm and depth of about 380 mm. The unit 37 comprises two prismatic bars 58, a chassis base 59 and connecting vertical members 61, of which only the rear ones are shown.

The bars 58 are hollow and they accommodate two guide rods 62, allowing them to slide. These two guide rods 62 are secured to bars 63 supporting the cabinet 32. By means of this structure, the unit 37 can be withdrawn forwards from the cabinet 32, after the door 49 has been opened, for easy maintenance of all its parts.

MAIL UNIT

The mail unit 37, illustrated in FIGS. 4 to 10, provides the weight data on the postal item 38, determines a franking amount in relation to the weight data and franks the postal item 38.

It comprises a compartment 64 for inserting the postal items 38, weighing devices 66 for providing weight data on the postal items inserted, checking devices 67 for checking that the physical dimensions of the postal items are within pre-established limits, franking devices 68 for franking the postal items 38 and handling devices 69 for moving the postal items after they have been franked from the compartment 64 to the post boxes 41 and 42 contained in the containment unit 39 below.

The compartment 64 for inserting the postal items is presented as a parallelepiped, for example 370 mm deep, comprising side walls 71, a bottom wall 72, a ceiling 73 and a supporting surface 74, all made of strong sheeting, for example stainless steel, to withstand acts of vandalism. An opening 76 on the door 49 of the cabinet 32 permits access to the surface 74.

The opening 76 can be closed by a vandal-proof door 77, which slides vertically and disappears. The door 77 may assume different operating configurations. As appropriate, it can change from a closed configuration to an open configuration, in which the postal items can be placed on the surface 74.

The vandal-proof door 77 comprises a body 78 made of strong transparent material, for example polycarbonate, so that the inside of the compartment 64 can be observed, and a top metal frame 79 secured to the outer edges of the body 78. Secured to the frame 79 are two blocks 81 sliding on vertical door guides 82, which permit vertical movements between the closed configuration and the open configuration. The blocks 81 comprise threaded nutscrews and the door guides 82 comprise, for example, two worm screws, connected in rotation by appropriate toothed pulleys 83 and toothed belts 84, driven by a door motor 86, which ensure the vertical movement of the vandal-proof door 77.

In its closed configuration (FIG. 5), the vandal-proof door 77 also ensures that the postal items 38 are franked in a closed environment separate from any possible handling by the user subsequent to their insertion in the compartment 64, and without the intervention of postal administration staff.

On the bottom wall 72, opposite the opening 76, the compartment 64 has a bulkhead 87 which slides vertically and constitutes a separating element between the compartment 64 for inserting postal items and the containment unit 39. The bulkhead 87 is guided in its movement by a vertical bulkhead guide 88, and is driven by a bulkhead motor 89, and can assume various operating configurations.

In the closed configuration of the bulkhead 87 (FIG. 9), operations relating to the processing of postal items 38 under the user's responsibility are permitted, and access to the containment unit 39 is disabled. In the open configuration of the bulkhead 87, the postal items 38 (FIGS. 9 and 10) can only be processed with the vandal-proof door 77 in the closed configuration, and in this configuration the movement of the postal items to the containment unit 39 and the boxes 41 and 42 it contains is permitted.

In the compartment 64, the supporting surface 74 at the same time constitutes the plate of the scales 91 of the weighing devices 66. The scales 91 are electronic, for example the SM 3800 model manufactured by Mettler-Toledo with a capacity of 6,000 grammes and a precision of 1 gramme throughout its capacity. The scales 91 are not described further since they are, per se, known.

The weighing devices 66 process the weight data of the scales 91 relating to a given postal item, and comprise means of transmitting these weight data to the electronic control unit 33.

The processing of the postal item 38 is subject, as a non-limiting example, to the correct positioning of the item itself in a limited area 92 of the supporting surface 74 and to certain dimensional limits of the postal item 38. The limited area 92 is positioned so as to correspond to a rectangular area comprising a rear right angle of the surface 74, with dimensions of about 140×90 mm. The dimensions 140×90 mm also represent the minimum dimensions of the postal item 38 that can be processed. The maximum transversal dimensions are basically those of the supporting surface 74, about 350×250 mm.

Figure 12:
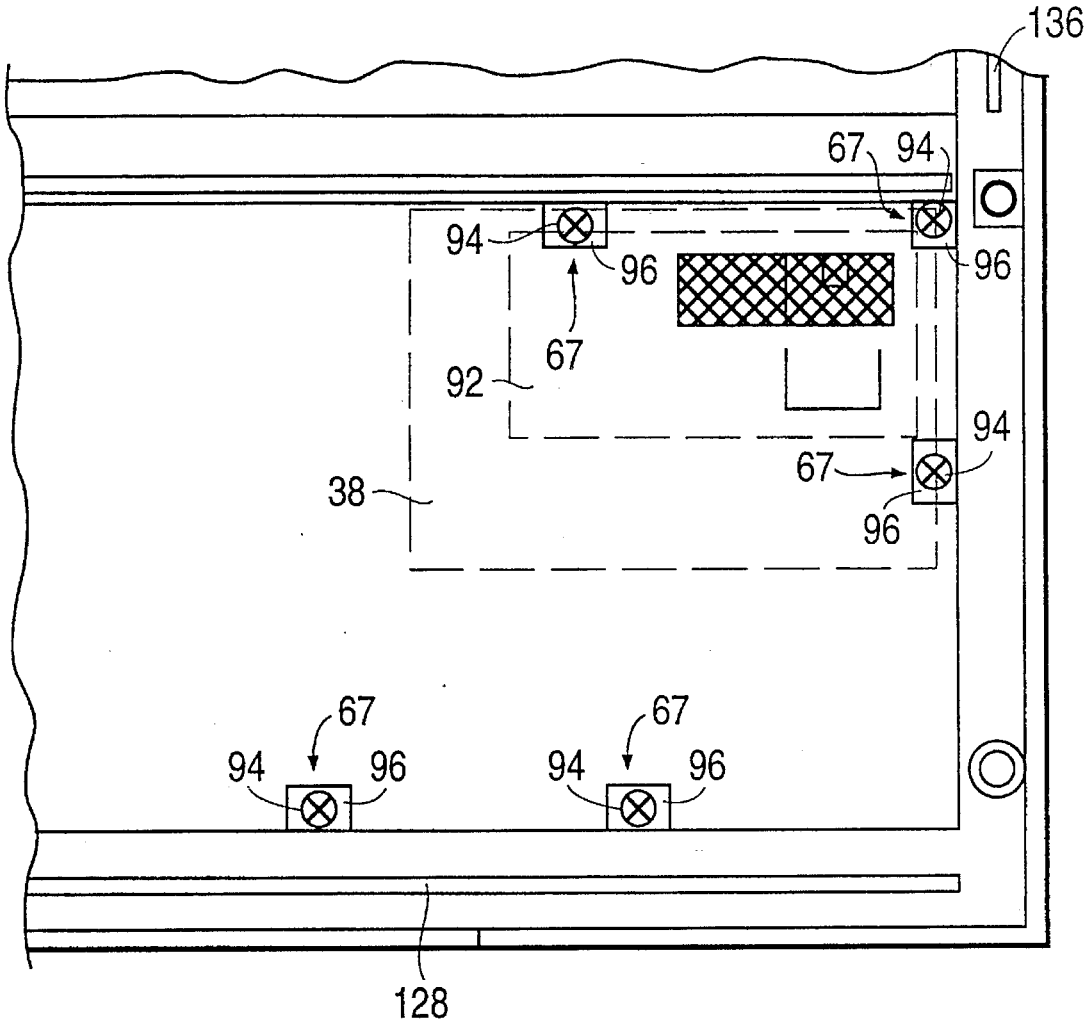
FIG. 12 shows a view from above of other details of the parts in FIG. 5.

To check the position of the postal item 38 and its minimum dimensions, in the compartment 64 there are alignment sensor devices 67 (FIGS. 7 and 12) comprising three optoelectronic components which operate on three vertices of the area 92. The check on the maximum dimensions of the postal items 38 is mechanical, and consists of the aperture of the compartment 64 which limits the width, for example, to 352 mm. The check on the thickness of the postal items inserted in the compartment 64 is assigned to an inclined wall 93 (FIG. 3) located at a defined distance from the supporting surface 74, in such a way as to prevent the insertion of postal items of a thickness greater than a given height. By way of example, this barrier has been made in the form of a mechanical stop, located at a height of 100 mm from the supporting surface 74, anchored rigidly to the load-bearing chassis of the compartment 64.

For checking the maximum depth of the item 38, there are excess size sensor devices comprising two optoelectronic components which operate on one front side of the supporting surface 74 at a distance of about 250 mm from the bulkhead 87.

Figure 8:
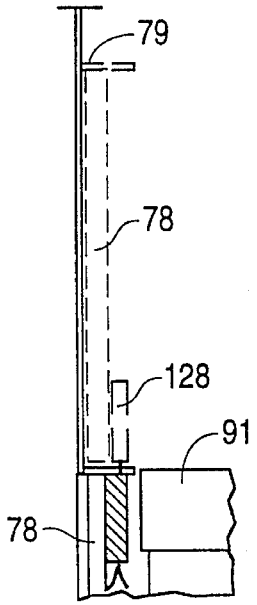
FIG. 8 shows a side view of a detail of FIG. 5 in various operating positions.
Figure 10:
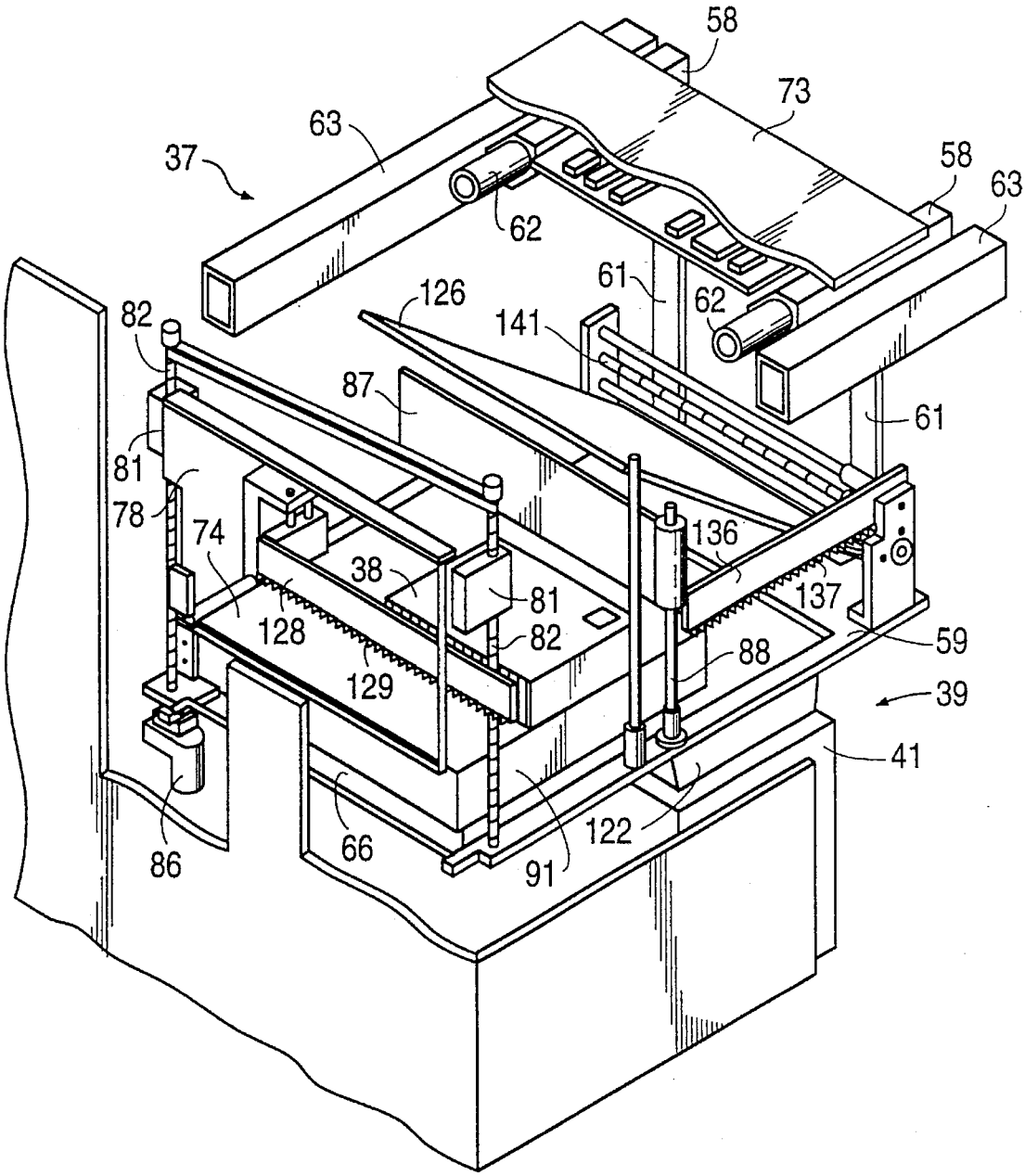

The optoelectronic components of the sensor devices 67 and 94 comprise, for example, photocells which are of the barrier type or in accordance with another electronic technology, positioned as shown in FIG. 8 with one pole, for example the transmitter, mounted on the ceiling 73 and the other pole, for example the receiver, mounted under the supporting surface 74. The sensor devices 67 and 94 are protected from malfunctions caused by the accumulation of dirt and from damage caused by acts of vandalism by protective devices 96, for example high-resistance transparent glass. The maximum depth may be 348 mm. The sensor devices 94 for checking the maximum depth are also used as means of checking the correct positioning of the postal items inserted in the compartment 64.

FRANKING DEVICES

Figure 11:
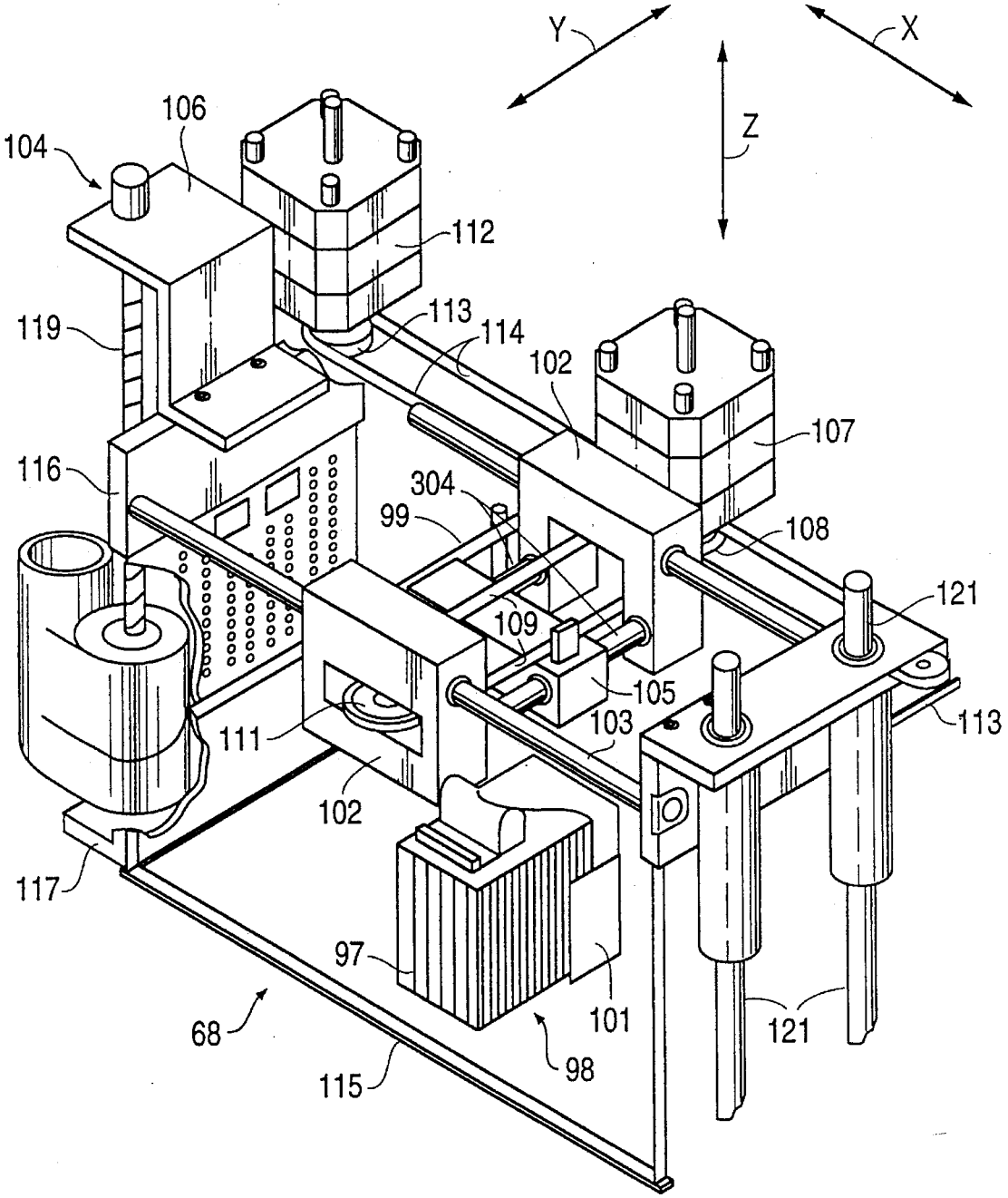
FIG. 11 shows a perspective view of details of the parts in FIG. 5.

The franking devices 68 are shown in FIG. 11 and franks the postal item 38 in accordance with two typical post office operations: affixing a stamp and postmarking it to obliterate and date it. The franking devices 68 comprise a print unit 97 (improperly called postmarking unit) with a print head 98 made, for example, in accordance with a technology involving impact by a needle head or without impact but with inkjet. The franking devices 68 also include a mechanical system for positioning the print unit 97 on the postal item to be franked consisting of a carriage 99, for mechanically supporting the head 98, and handling devices for movements of the carriage 99 in accordance with the X and Y coordinates.

According to a preferred embodiment of the invention, the print head 98 is of the inkjet type, for example Olivetti XG 350/C, and it is mounted in removable fashion on a mounting 101 and has 60 jets, of a diameter of about 50 microns, with the possibility of printing on any type of paper with a flatness of +/−3 millimeters. The mounting for the print head 98 is secured by known means to the carriage 99. The travel of the carriage 99, limited by the mechanical dimensions of the compartment 64, determines the dimension of the postmark (FIG. 12) and its position on the postal item subjected to franking.

The carriage 99 comprises in particular two interconnected blocks 102 sliding on two transversal guides 103, with the possibility of transversal movement on the X axis in relation to the postal item to be franked. The two blocks 102 are joined to each other by two longitudinal guides 304 on which a block 105 slides. The mounting 101 of the print head 98 is fitted in overhanging fashion on the block 105, with the possibility of longitudinal translation on the Y axis in relation to the compartment 64.

The movement of the head 97 in relation to the two blocks 102 is determined by a motor 107, on whose shaft is fitted a pulley 108 and which is attached to one of the two blocks 102. The pulley 108 operates a toothed belt 109 relayed by a second pulley 111 which rotates on the other of the blocks 102. A branch of the belt 109 is attached to the block 105 and each of its movements is equivalent to a longitudinal translation of the head 97.

Similarly the transversal movement on the X axis of the head 97 is determined by a second motor 112, attached to one side of the portal 104, and on whose shaft is fitted a first pulley 113 carrying a toothed belt 114 which rotates on another side of the portal 104. A branch of the belt 114 is secured to the block 102. Each movement of the belt 114 is equivalent to a transversal translation on the X axis of the print head 98.

The portal 104 has a top part 106 on which the guides 103 and motor 112, a side piece 116 and a bottom piece 117 with a stop bar 115 are secured. The portal 104, the carriage 99 and its handling devices are in turn moved in relation to the Z axis by a third motor 118 secured to the structure of the mail unit 37, and via a worm screw 119, which rotates between the parts 106 and 117 of the portal 104. The motion of the portal 104 corresponds to the motion of the print head 98. The portal 104 is guided in its vertical movement by two cylindrical guides 121, and it positions the head 97 at an optimum distance from the postal item 38, when the stop bar 115 rests on the said postal item 38.

For the movements of the head 97 along the X, Y and Z axes, the relevant motors 107, 112 and 118 are, for example, direct current motors, 34 V, 2 amp. short-circuit current, with encoders. All the motors have maximum current limiting circuits calibrated in accordance with the permitted maximum overload. The status of the bar 115 resting on the postal item 38 is recognized, in a known manner, by the feedback signals of the encoder associated with the motor 118. According to this structure, it is clear that the head 97 can move freely across the area 92 where the postal item 38 can be positioned, and it can print a logo relating to the postal administration and the franking amount on postal items of different thicknesses and dimensions.

CONTAINMENT UNIT

Figure 6:
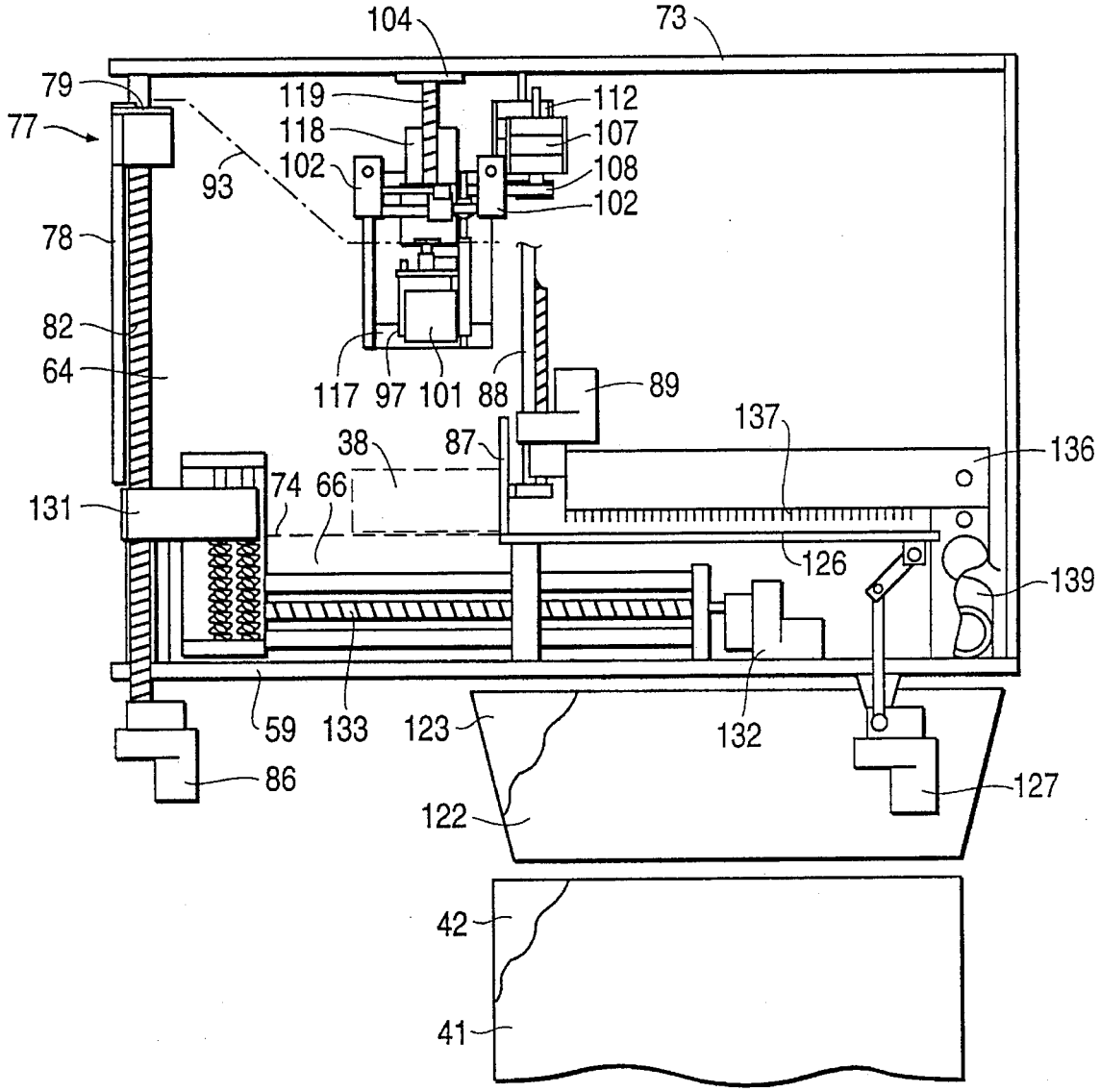
FIG. 6 shows a side section of the parts in FIG. 5.
Figure 7:
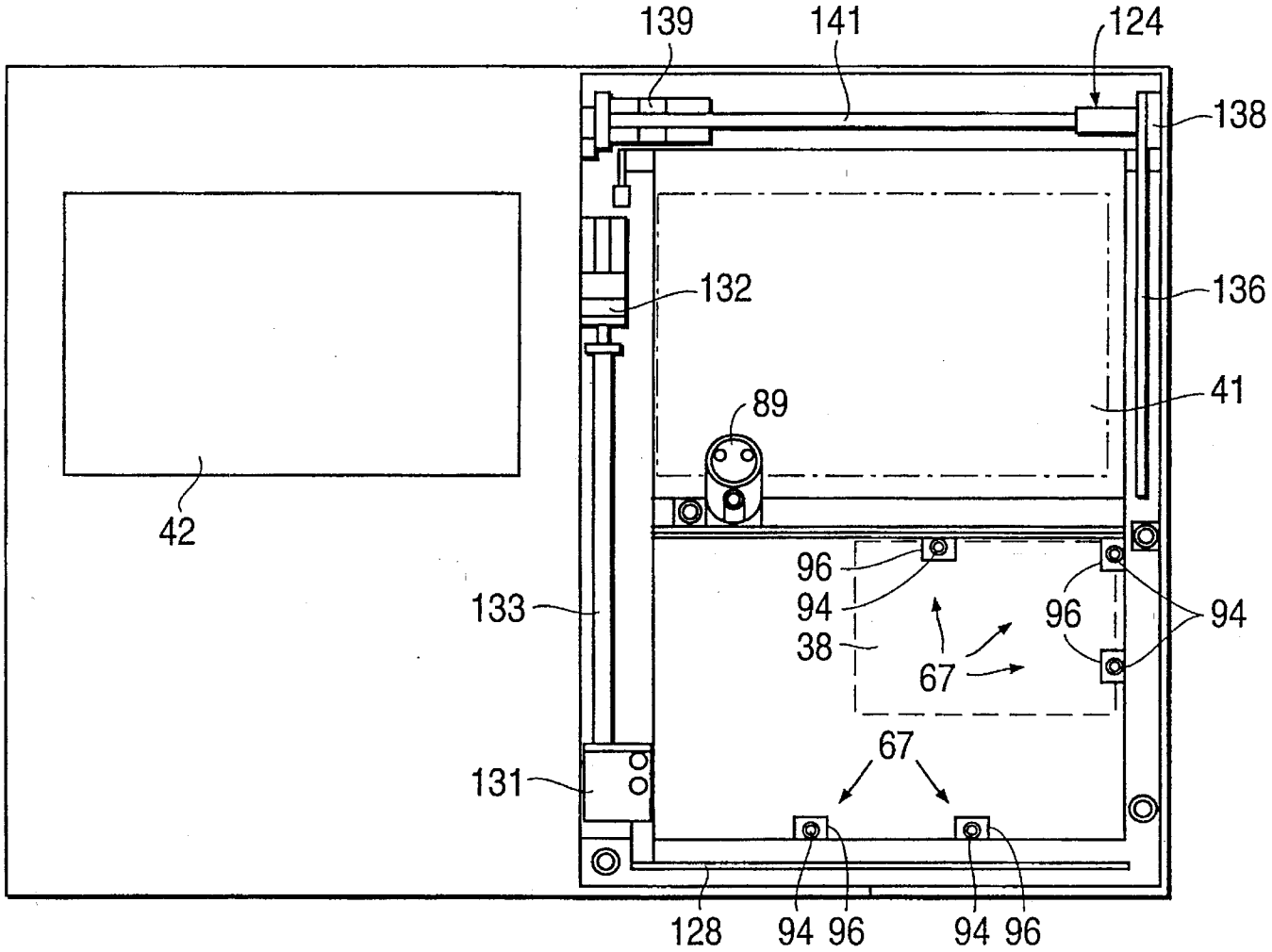
FIG. 7 shows a view from above of the parts in FIG. 4.
Figure 9:
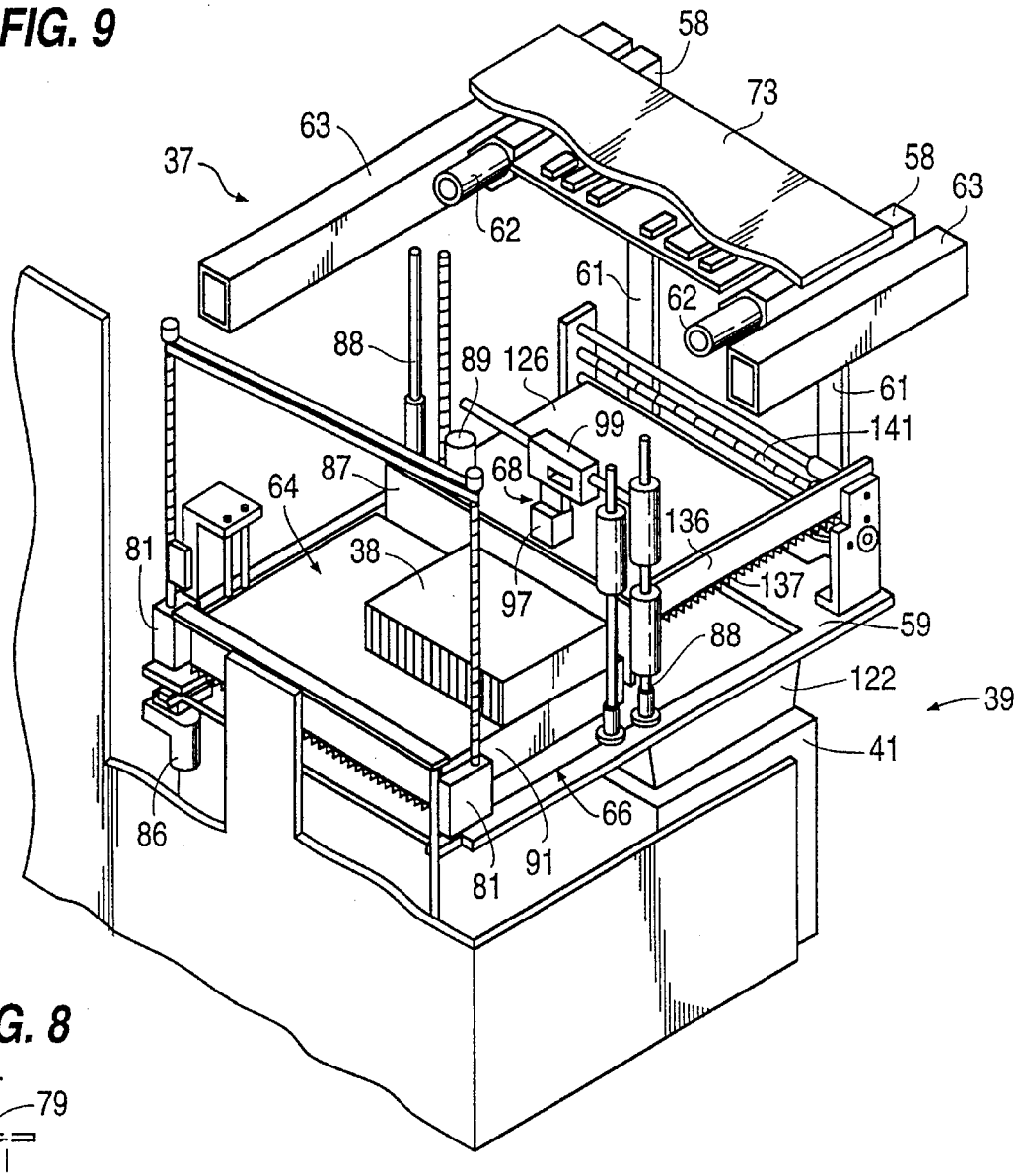
FIGS. 9 and 10 show perspective views of the parts of FIG. 5 in different operating positions.

FIGS. 3 and 6 show the containment unit 39 and details of the components of the handling devices for moving the postal items after franking from the supporting surface 74 to the containment unit 39. The unit 39 occupies the entire bottom of the system 31. On the right, it houses the box 41, which is allocated for containing postal items belonging to a particular postal tariff category, for example ordinary post. On the left, the unit 39 houses a second box 42 for containing postal items belonging to another postal tariff category, for example registered post.

The containment unit 39 comprises a conveyor 122 near the bottom of the base chassis 59 of the unit 36, underneath it, for conveying the appropriate postal items 38 to the box 41. The unit 39 also comprises a conveyor 123 beside the conveyor 122 and shifted to the left of the chassis 59, for conveying the appropriate postal items to the box 42.

HANDLING DEVICES

The handling devices in turn comprise first collection devices for moving the postal items inserted in the compartment 64 from the supporting surface 74 to the first box 41 or to an intermediate position, and second collection devices 124 (FIG. 7) for moving postal items from the intermediate position to the second box 42. The destination of the postal items—the first or second box—is determined by the preselected postal and tariff category.

The first box 41 has a cover 126 (FIG. 10 and preceding) moved by a motor 127 for covering its top. The cover 126 can assume two different operating configurations. It is in its open configuration when the first box 41 has to receive the postal items subjected to franking. In the closed configuration the cover 126 is on the same plane as the supporting plate 74 and it is also the supporting surface over which the postal items intended for the second box 42 pass in their intermediate position. The change from the closed configuration to the open configuration and vice versa takes place under the control of the electronic control unit 33, by means of handling devices which are per se known, and so are not described in detail, operated by the motor 127.

The first collection devices comprise a rake with a metal bar 128, ending in a hard bristle band 129 attached to a mounting block 131 and moving in a longitudinal direction. Thick postal items are moved from the supporting surface 74 to the cover 126 of the first post box 41 by means of the bar 128, while thin and light items are moved by the hard bristle band 129. The mounting block 131 is moved by a third motor 132, of the 34 V direct current type, which transmits motion to transmission devices 133, for example of the worm screw type, joined to the block 131 which is further guided in its movement by guides 134.

The second collection devices 124, similar to the first collection devices, comprise a rake with a bar 136 ending in a hard bristle band 137, attached to a second mounting block 138 and moving in a transversal direction to move the postal items from the cover 126 of the first box 41 to the second box 42. The movement of the second mounting block 138 is determined by a fourth motor 139, of the 34 V direct current type, which transmits motion to second transmission devices 141, for example of the worm screw type, joined to the block 138 which is further guided in its movement by second guides 142.

STAMP DISPENSING UNIT

At the top of the basic cabinet 32, there is the stamp dispensing unit 46 (FIG. 2), which is per se known. For example, the product used is of the type called Stamp Center 847 made by Klussendorf, comprising devices for securing the roll of stamps to prevent it falling, end-of-paper sensors, an optic sensor for checking that the franking amount has been transferred correctly to the stamp, an electronic interface and a stamp outlet 143. The interface, for example of the RS232 serial type, serves to connect the unit 46 to the electronic control unit 33 which manages and controls it. The outlet 143 is connected on the left of the top door 49 at a height such as to permit its easy use by the user.

ENVELOPE DISPENSING UNIT

The envelope dispensing unit 47 (FIG. 2) is also housed at the top of the basic cabinet 32. It comprises an envelope outlet slot 144 and a body of a known type as described in the Italian patent No. 1130118 issued on 11th Jun. 1986 in the name of Ing. C. Olivetti & C. S.p.A.

PAYMENT UNIT

The payment unit 43 (FIG. 2), also contained at the top of the cabinet 32, comprises a slot 146 for inserting coins, a device 147 for validating the coins inserted in the slot 146, and a change return device 148. It also comprises a pre-encashment box 149 for returning coins inserted by the user in the case of faulty conclusion of the transaction, a removable cash box for collecting the coins inserted in the slot 146, and connecting pipes between the various devices constituting the unit 43. The unit 43 finally comprises an electronic interface device with the electronic control unit 33, a read and write device 151 for credit cards and charge cards and a chassis 152 for mechanically supporting the various devices.

The slot 146 is positioned at a height, for example, of about 1300 mm to facilitate its use by users, and comprises a vandal-proof door with an automatic opening/closing device for protecting the slot 146 against the insertion of undesired objects. The coin outlet device consists of the same compartment 143 used as the stamp outlet and, for example, is made with a vandal-proof door of a transparent material opened by pushing, and comprising a return spring. It is not illustrated and described in detail since it is per se known. The validator 147 of the coins inserted is positioned immediately behind the slot 146. In the system 31, for example the C335 validator made by Coin Controls is used, which is per se known, and can recognize 36 different coins and indicate recognition.

The change return device 148, for example made using the Compact Payout systems by Coin Controls, consists of tubes whose function is to store the coins, mounted vertically on a device for expelling the coins from the tubes. To permit sufficient operating range, the system 31 is configured with 5 tubes located immediately after the validator 147.

The system 31 is completed by a read and write device 151 for credit cards and charge cards, comprising a slot 153 for inserting the cards and a known base unit, for example of the BRW 4653 type with buffer battery for returning the card in the event of a power cut.

ELECTRONIC ARCHITECTURE

FIG. 13 contains a block diagram of the electronic architecture of the system 31 in a possible realization, illustrated by way of a non-limiting example. Any functionally equivalent variant enters within the scope of this patent.

The electronic unit 33 consists of a personal computer, for example of the Olivetti M300-05 type configured with a central RAM of 3 Mbytes, an HDU mass storage of 40 Mbytes and a 3.5" floppy disk drive. To the computer are connected the data and commands input unit 34, comprising a 16-key numerical keyboard mounted on a cast mounting for integration on the base cabinet 32, and a 14" screen 36 with protective glass.

The peripherals of the system 31 are managed by the electronic unit 33 by a series of interfaces 35/1, 35/2, 35/3, and 35/4, each of which is dedicated to a specific function. 35/1 indicates the FEP (Front End Processor) interface which manages the envelope dispenser 47, the credit card/debit card reader 151, included in the payment unit 43 and the print device 44 used for issuing the receipt at the end of the transaction. 35/2 indicates the line interface, for example of the LPU type, which constitutes the intelligent controller of the connection of the personal computer 33 with the mains on the X25 telephone line. 35/3 indicates an interface card containing a set of four RS232 serial lines each of which is dedicated to a specific peripheral. The first RS232 constitutes an optional connection with a remote central computer. The second RS232 line places the personal computer 33 in communication with the coin payment unit 43 which in turn manages and monitors the following devices: coin validator 147, change return device 148, pre-encashment box 149 and cash box 150.

The third RS232 constitutes the line through which the personal computer 33 communicates with and manages the stamp dispenser 46. Finally the fourth RS232, converted into a 20 mA current loop line by an interface 35/4, places the mail unit 37 in communication with the personal computer 33. As shown in FIG. 13, the mail unit 37 has its own intelligent controller 60 for managing, under the supervision of the personal computer 33, sensors 94 for monitoring the correct insertion and the maximum dimensions of the postal item 38, and limit sensors of known type for monitoring the travel of the moving mechanical devices (doors, bulkhead, handling devices). The controller 60 also monitors and manages the motors 80 for actuating the above-mentioned mechanical devices, the postmark printer 97, the franking unit 68 and the scales 91.

The FIGS. from 14A to 14E illustrate a flow diagram of the functions implemented on the electronic franking system for postal items.

The operations commence with the initialization of the system 31, as shown in the block 201, this meaning the set of electronic/mechanical operations which prepare the system 31 for operation.

As shown in block 202, the next procedure is a wait cycle during which the electronic unit 33 interrogates, at regular intervals, the unit 34 to activate the system 31 in response to a request to operate from a user. The possibilities offered by the system 31 are: the sale of stamps 203, the sale of postcards or envelopes 204, the sending of ordinary mail 206 and the sending of recorded mail 207.

The selection of sending recorded mail causes the vandal-proof door 77 to open immediately, block 208. The user can now insert, block 209, the postal item 38 into the compartment 64. A cycle of checks by means of the sensors 94 on the dimensions and position of the postal item is activated, as described in the blocks 211, 212 and 213.

In the case of a fault resulting from incorrect insertion or a non-standard postal item, an error message is displayed, block 228, resulting in the withdrawal of the postal item 38, block 229, and the subsequent closure of the vandal-proof door, block 231. The system 31 then returns to the initial rest state.

If all the checks have given a negative result, block 212 inquiry yes, the vandal-proof door is closed, block 214, preventing any possible external handling during the subsequent stages of the franking cycle. The system requests and the user enters the data relating to the postal item to be sent, block 216. The system 31 automatically weighs the postal item 38, calculates the franking amount and displays it on the screen 36, block 217. At this point the user is offered the possibility of aborting the transaction, blocks 221 inquiry NO and 222 inquiry Yes, if so desired; otherwise the amount due is paid, blocks 218, 219 and 221 inquiry YES or 218, 219, 221 inquiry NO and inquiry NO with the possible return of change following the insertion of a higher amount, block 223.

After checking that the franking amount has been correctly inserted, the system 31 enables the franking unit, block 224, to print the stamp on the postal item 38, block 226. The moving bulkhead 87 is raised, block 227, to allow the postal item 38 to be transferred from the compartment 64 to one of the two post boxes 41 or 42 containing the postal items. In the case of recorded mail, for example registered mail, the postal item 38 is posted in the post box no. 1, block 242, after the relevant cover has opened and the handling devices no. 1 have been operated, blocks 239 and 241. In the case of another type of recorded mail, the postal item 38 is posted in the post box no. 2, block 237, after the cover of box no. 1 has closed, block 235, and the handling devices no. 1 and no. 2 have been operated, blocks 234 and 236. After posting, block 238, all the devices of the system 31 previously handled are returned to their rest state, a receipt is issued and an end-of-operation message is displayed.

In the case of a request to sell stamps, block 203, the system 31 asks the user to insert the amount for the stamps, block 243. This amount is then paid by coins or charge or credit cards, blocks 244 and 246. Before the payment operation is concluded, the user is offered the possibility of aborting the transaction in progress, blocks 247 inquiry NO and 248 inquiry Yes, or completing the operation with the receipt of change, if applicable, and the final issue of the stamps requested, blocks 247 inquiry NO, 248 inquiry NO, 249 and 251 or blocks 247 inquiry YES and 251. The end-of-operation message, block 252, closes the stamp sale cycle and allows the system 31 to return to its initial state.

The selection of "sale of postcards or envelopes", block 204, enables the user to enter the sum or the number of postcards or envelopes to be collected, block 253. The payment of this sum is then requested, and it may be made by coins or charge or credit cards, blocks 254 and 256. As in the case of collection of stamps, the user is offered the possibility of aborting the transaction in progress, blocks 247 inquiry NO and 248 inquiry YES, or completing the payment operation resulting in the receipt of the required envelopes or postcards, blocks 247 inquiry NO, 248 inquiry NO, 249 and 251 or blocks 247 inquiry YES and 251. The end-of-operation message, block 252, concludes the selected transaction and allows the system 31 to return to the initial state.

The request to process ordinary mail, block 206, causes the vandal-proof door to open immediately, block 263, so that the postal item 38 can be inserted in the compartment 64, block 264. Checks are not conducted since the procedure relating to the processing of ordinary mail includes answers which are purely for information. Then, blocks 266 and 267, the data relating to the postal item 38, to weighing and to the subsequent calculation and display of the franking amount are then entered. The user can close the transaction, blocks 268 inquiry NO, 276, 277 and 278 having obtained the desired information, or request the purchase of stamps for an amount equal to the franking amount calculated by the system 31, block 268 inquiry Yes. In the latter case, the procedure for payment and the issue of stamps described above is activated, blocks 269, 271 inquiry YES and 274 or blocks 269, 271 inquiry NO, 273 and 274. At all events, at the end of the required operation there is the collection of the postal item from the compartment 64, the closure of the vandal-proof door and the return of the system to the initial waiting state, blocks 276, 277 and 278.

From the above description, it is clear that the franking system is entirely independent of the presence of monitoring staff from the postal administration. From the user's point of view, it can therefore be defined as of the "self service" type.

I claim:

1. Electronic franking system comprising:

an area for depositing a postal item;

devices for determining a franking amount;

a franking unit;

sensor devices which provide signals indicating correct positioning of the postal item in a limited zone of said deposit area;

a print unit that can print the said franking amount;

handling devices for handling said print unit; and, electronic control devices conforming to the signals of the said sensor devices for activating said handling devices and said print unit for positioning said print unit on the postal item in said limited zone for franking said postal item.

2. Electronic franking system according to claim 1, wherein said print head is of the inkjet type.

3. Electronic franking system according to claim 1, wherein said handling devices comprise devices for longitudinal movement of said print unit in relation to said limited zone (X axis), devices for transversal movement in relation to said limited zone (Y axis) and devices for movement perpendicular to said limited zone (Z axis).

4. Electronic franking system according to claim 1, wherein said control devices comprise devices for controlling said print unit, devices for driving said handling devices and interface devices for connection to said electronic control unit.

5. Electronic franking system comprising:

a deposit area for depositing a postal item;

a device for determining a franking amount;

a franking unit;

a post box for receiving the postal items after franking; and a handling mechanism actable for moving a postal item from said deposit area to said post box;

wherein said handling mechanism comprises a moving rake disposed substantially parallel to said deposit area whereby said rake moves both thick and thin postal items.

6. Electronic franking system according to claim 5, wherein said handling mechanism further comprises an activating mechanism for moving said rake from a rest position to a working position.

7. Electronic franking system according to claim 6, wherein said moving rake comprises a rigid bar and sliding means associated to said rigid bar, whereby said sliding means brush against said deposit area when said moving rake is in said working position.

8. Electronic franking system according to claim 5, wherein said electronic franking system further comprises a door actable for rendering said deposit area selectively unaccessible to a user during the movement of said rake.

9. Electronic franking system comprising:

a substantially horizontal deposit area for depositing a postal item;

a device for determining a franking amount to be printed on said postal item;

a post box for receiving said postal item after franking;

a franking unit comprising a print unit having a print head operable to move in X, Y and Z directions with respect to said deposit area and for printing said franking amount on said postal item deposited on deposit area; and a handling mechanism actable for moving said postal item from said deposit area to said post box after franking.

10. Electronic franking system according to claim 9, wherein said print unit comprises a stop bar having feedback means for stopping the movement of said print head towards said postal item at a predetermined distance from said postal item.

* * * * *